US011601744B2

(12) United States Patent
Liu

(10) Patent No.: US 11,601,744 B2
(45) Date of Patent: Mar. 7, 2023

(54) HEADPHONE ALIGNMENT SYSTEMS AND METHODS

(71) Applicant: SYNAPTICS INCORPORATED, San Jose, CA (US)

(72) Inventor: Wensen Liu, Irvine, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 49 days.

(21) Appl. No.: 17/338,489

(22) Filed: Jun. 3, 2021

(65) Prior Publication Data

US 2021/0400368 A1 Dec. 23, 2021

Related U.S. Application Data

(60) Provisional application No. 63/043,004, filed on Jun. 23, 2020.

(51) Int. Cl.
*H04R 1/10* (2006.01)

(52) U.S. Cl.
CPC ..... *H04R 1/105* (2013.01); *H04R 1/1008* (2013.01); *H04R 1/1083* (2013.01)

(58) Field of Classification Search
CPC . H04R 1/00; H04R 1/02; H04R 1/028; H04R 1/10; H04R 1/1008; H04R 1/105; H04R 1/1083; H04R 1/1041; H04R 1/1075; H04R 1/1058; H04R 1/1066; H04R 1/1091; H04R 1/288
See application file for complete search history.

(56) References Cited

U.S. PATENT DOCUMENTS 4,058,688 A * 11/1977 Nishimura ..... H04R 1/1008 381/372
5,138,722 A * 8/1992 Urella ..... H04R 1/1008 D14/206
5,821,468 A * 10/1998 Urella ..... A61F 11/14 181/129
6,122,383 A * 9/2000 Berge ..... H04R 3/00 181/158
6,163,615 A * 12/2000 Callahan ..... H04R 1/1008 381/372
6,683,965 B1 * 1/2004 Sapiejewski ..... H04R 1/1083 381/370
10,779,074 B1 * 9/2020 VanBlon ..... H04R 1/1008
2005/0089185 A1 * 4/2005 Allen ..... H04R 1/1008 381/370

(Continued)

FOREIGN PATENT DOCUMENTS

CN 207369238 U * 5/2018 ..... H04R 1/10
KR 10-1558020 B1 10/2015
KR 10-1682613 B1 12/2016

OTHER PUBLICATIONS

Zhang Ling, CN-207369238-U English Translation, Dated May 2018.*
International Search Report and Written Opinion, dated Oct. 14, 2021, from PCT/US2021/038481 , filed Jun. 22, 2021, pp. 1-8.

*Primary Examiner* — Thang V Tran
(74) *Attorney, Agent, or Firm* — Paradice & Li LLP

(57) ABSTRACT

An on-ear headphone includes an alignment structure extending into the user's concha to help the user to align the headset for optimal comfort and sound perception. The alignment minimizes sound leakage, optimizes audio playback, and improves active noise cancelation.

18 Claims, 7 Drawing Sheets

(56) References Cited

U.S. PATENT DOCUMENTS

| | | | | |
|---|---|---|---|---|
| 2011/0216909 | A1* | 9/2011 | Sapiejewski | H04R 1/1083 381/371 |
| 2012/0014532 | A1* | 1/2012 | Kimura | H04R 1/1083 381/71.6 |
| 2013/0279724 | A1 | 10/2013 | Stafford et al. | |
| 2014/0079270 | A1* | 3/2014 | Essabar | H04R 1/1008 381/370 |
| 2015/0092976 | A1* | 4/2015 | Kirsch | H04R 1/1058 381/371 |
| 2016/0073193 | A1 | 3/2016 | Kirkpatrick | |
| 2017/0208380 | A1 | 7/2017 | Slater et al. | |

* cited by examiner

HEADPHONE ALIGNMENT SYSTEMS AND METHODS

CROSS-REFERENCE TO RELATED APPLICATIONS

This application claims priority to and the benefit of U.S. Provisional Patent Application No. 63/043,004 filed Jun. 23, 2020, entitled "HEADPHONE ALIGNMENT SYSTEMS AND METHODS", which is hereby incorporated by reference in its entirety.

TECHNICAL FIELD

The present disclosure relates generally to headphones. Some embodiments, for example, provide on-ear headphone structures facilitating headphone alignment relative to the ear.

BACKGROUND

FIG. 1A is a schematic illustration of a headset 104 with headphones 110 interconnected by a resilient headband 120. FIG. 1B is a perspective view of a headset, such as the headset 104. The headband 120 forces the headphones 110 towards and onto the user's ears 140. The headphones' speakers 144 receive electrical and/or electromagnetic signals from a mobile or stationary device 150 (a mobile phone, a sound recorder, a tablet, a mobile computer, a television, a radio station transmitter, or some other type) over a wired or wireless link 154, and convert such signals to sound (music, speech, or other type) transmitted to the user's ears 140.

Various implementations include headphones designed to rest on or press against the user's ears (outer ears, i.e. pinnae), or on the user's head around the ears. The first type, called "on-ear" phones, is typically less bulky than the "over-the-ear" phones of the second type. The on-ear phones also provide better ear ventilation (air flow between the ear and the ambient) than over-the-ear phones. To counteract environmental noise that may interfere with audio playback, the headphones can be provided with Active Noise Cancellation (ANC) circuitry 160, which senses the environmental noise and generates anti-noise sound out of phase with the environmental noise to cancel the environmental noise through destructive interference. On-ear headphones, however, often have more sound leakage (e.g., through gaps between the headphone and the outer ear), including more noise leakage from the environment and more sound escaping from the speakers than over-the-ear headphones, which leads to the loss of low frequencies and degrades ANC performance. In addition, the listening experience, including ANC performance, can be further degraded by the misalignment of on-ear headphones by the user.

In view of the foregoing, there is a continued need in the art for improved headphone designs, including designs for on-ear headphones that reduce leakage, minimize misalignment, and/or improve ANC performance, in order to improve the user's listening experience.

SUMMARY

This section summarizes some features of the present disclosure, which is defined by the appended claims and which are incorporated into this section by reference.

Headphones can be tested by designers or manufacturers to optimize the acoustic performance and user comfort.

Extensive testing is facilitated by specialized manikins (e.g., Knowles Electronics Manikin for Acoustic Research, Head and Torso Simulator, etc.) and/or live human subjects. Yet it is challenging to test and configure headphone performance for all possible users and all possible head and ear shapes. Even if exhaustive testing were possible, it is lengthy and costly. Moreover, a given user may wear the headset differently at different times, making it challenging to test or optimize the headphones for all the different headset positions. Such problems are especially acute for on-ear phones because the on-ear phones can shift along the pinnae to assume a myriad of positions.

Some embodiments of the present disclosure stabilize on-ear headphone positioning by providing the headphones with alignment structures that extend towards the user's conchae—the ear cavity adjacent to the ear canal. In some embodiments, the alignment structures are adapted to fit in the user's conchae to hold the headphones in a preferred alignment with the ears. In some embodiments, the alignment structure may be in a form of a wing having a tactile function of assisting the user to properly align the headphones for optimal sound. For example, the user can feel the properly fitting wings when they are properly positioned in the conchae, and/or can feel the wings when they are mispositioned. In some embodiments, when the headphones are properly positioned, the wings do not apply force to the ears, and in some embodiments may not even touch the ears—e.g., the wings may touch the ears only when the headphones are mispositioned. The wings can be designed to optimally align the speakers with the ear canals, minimize sound leakage, and improve ANC effectiveness. In some embodiments, the wings are further designed to fit the conchae to assist in maintaining the headphones in proper alignment.

By using the alignment structure of the present disclosure, headphone testing and optimization is simplified because the testing and optimization can be based on proper headphone positioning as defined by the alignment structure. Further, the wing and earphone padding may be integrated as a single earpad. The wing and earphone padding are further adapted to seal the ear from the external environment, reducing leakage and allowing for optimal audio performance.

In various embodiments, an apparatus such as an on-ear headset includes a headphone body having a first surface having a sound emitting portion, one or more speakers disposed in the headphone body and arranged to emit sound through the sound emitting portion of the first surface, and an alignment structure protruding from the first surface and adapted to guide an alignment of the headphone body with an ear.

In some embodiments, a headset further includes a resilient headband attached to the headphone body and adapted to bias the first surface of the headphone body towards the ear, and an earpad attached to the first surface that substantially conforms to an outer ear structure to reduce sound leakage paths. The alignment structure is adapted to be attached to an exterior of the earpad, on an interior of the earpad, connected to the headphone body through an opening in the earpad and/or in the headphone body adjacent to the sound emitting portion.

In some embodiments, the alignment structure is adapted to guide the headphone body to form a sound path between the sound emitting portion and an ear canal opening. The alignment structure is adapted to fit into an opening formed in a concha of the ear when the headphone body is aligned with the ear and contact the concha to perceptually indicate to the user a misalignment of the headphone to the ear.

The headset may further include active noise cancellation (ANC) circuitry adapted for use with the alignment structure. In some embodiments, the alignment structure limits the range of comfortable headphone alignment positions and, when aligned, optimizes the sound path from the speaker to the ear canal while reducing leakage due to misalignment between an earpad and the ear structure. In some embodiments, the ANC circuitry is tuned for common alignment scenarios to optimize ANC performance.

The present disclosure is not limited to the features described above except as defined by the appended claims. For example, a headset may have only one earphone, and may or may not include ANC. The alignment structure may apply force to the conchae sufficient to hold the headphones in place or provide a tactile guide to encourage proper positioning by the user. The headset may be part of a Virtual Reality system or some other gear.

BRIEF DESCRIPTION OF THE DRAWINGS

Aspects of the disclosure and their advantages can be better understood with reference to the following drawings and the detailed description that follows. The included drawings are for illustrative purposes and serve only to provide examples of possible systems and methods for the disclosed methods and systems. These drawings in no way limit any changes in form and detail that may be made to that which is disclosed by one skilled in the art without departing from the spirit and scope of this disclosure.

DETAILED DESCRIPTION

Various embodiments of the present disclosure will now be described with reference to the figures. In various embodiments, an apparatus such as an on-ear headset includes a headphone body having a first surface having a sound emitting portion, one or more speakers disposed in the headphone body and arranged to emit sound through the sound emitting portion of the first surface, and an alignment structure protruding from the first surface and adapted to guide an alignment of the headphone body with an ear.

In some embodiments, a headset further includes a resilient headband attached to the headphone body and adapted to bias the first surface of the headphone body towards the ear, and an earpad attached to the first surface that substantially conforms to an outer ear structure to reduce sound leakage paths. The alignment structure is adapted to be attached to an exterior of the earpad, on an interior of the earpad, connected to the headphone body through an opening in the earpad and/or in the headphone body adjacent to the sound emitting portion.

In some embodiments, the alignment structure is adapted to guide the headphone body to form a sound path between the sound emitting portion and an ear canal opening. The alignment structure is adapted to fit into an opening formed in a concha of the ear when the headphone body is aligned with the ear and contact the concha to provide the user with a tactile guide to correct the misalignment of the headphone to the ear.

The headset may further include active noise cancellation (ANC) circuitry adapted for use with the alignment structure. In some embodiments, the alignment structure limits the range of comfortable headphone alignment positions and, when aligned, optimizes the sound path from the speaker to the ear canal while reducing leakage due to misalignment between an earpad and the ear structure. In some embodiments, the ANC circuitry is tuned for common alignment scenarios to optimize ANC performance.

Figure 1A:
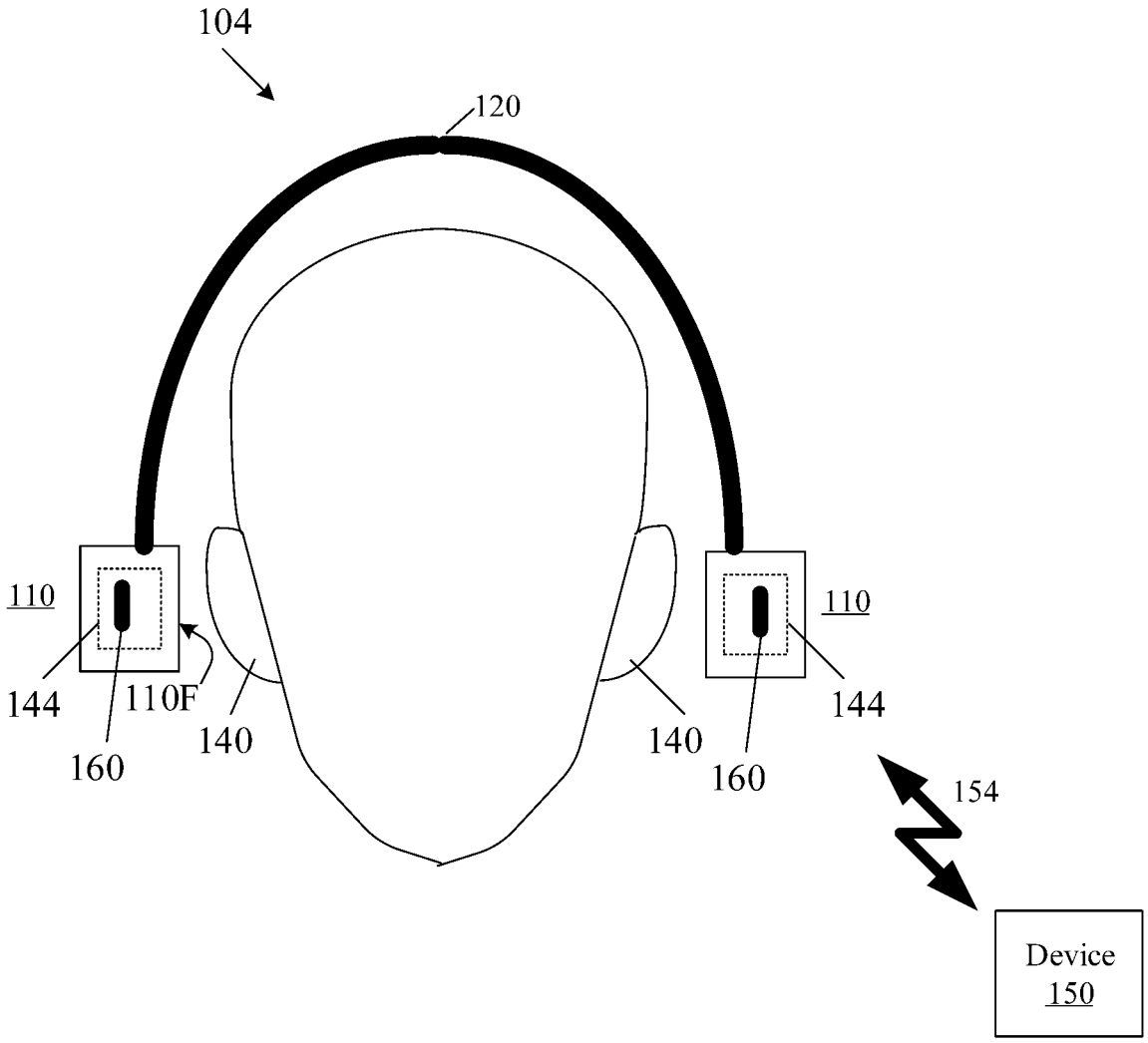
FIG. 1A illustrates a user wearing a headset with headphones.
Figure 1B:
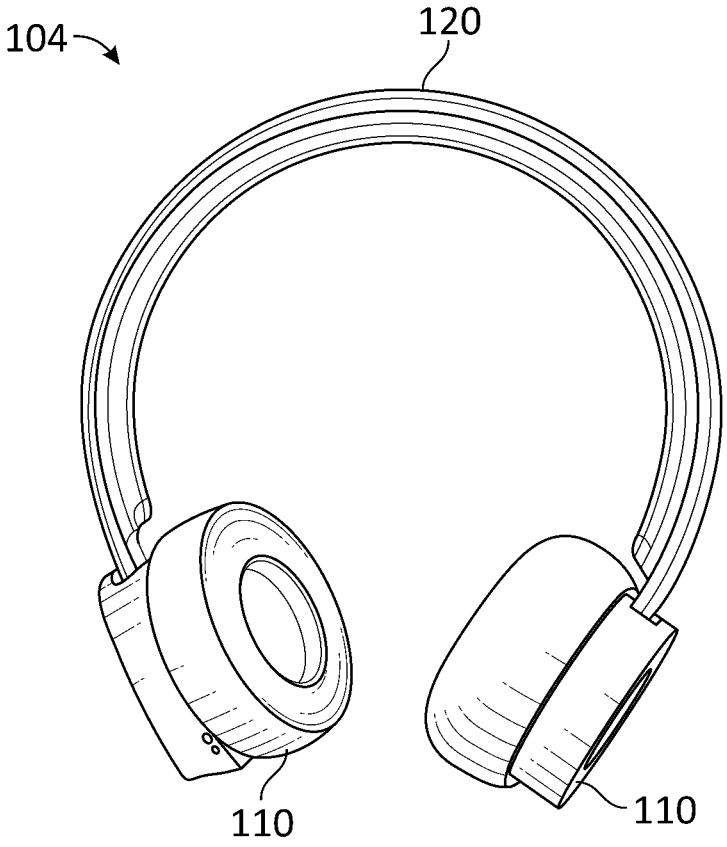
FIG. 1B illustrates a headset with headphones.
Figure 2A:
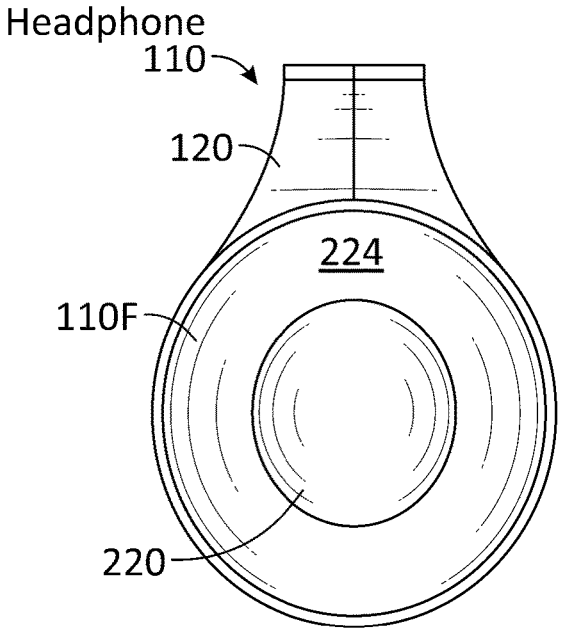
FIG. 2A is a front view, as seen from the user's ear direction, showing a headphone with an alignment structure removed, in accordance with one or more embodiments.
Figure 2B:
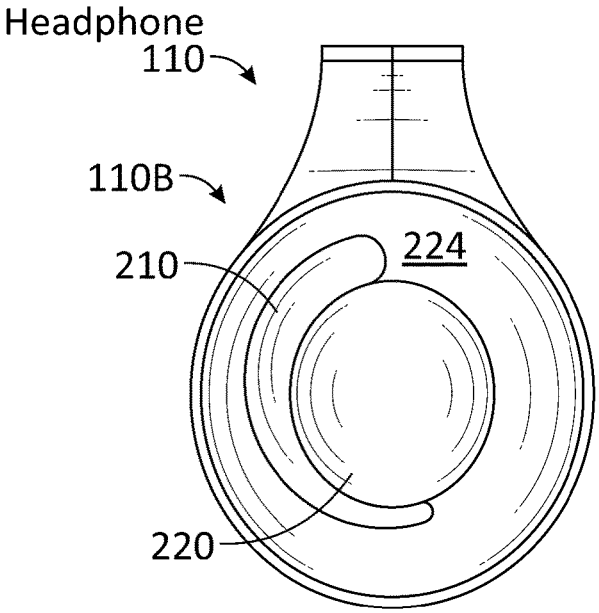
FIG. 2B is a front view of a headphone with an alignment structure, in accordance with one or more embodiments.
Figure 2C:
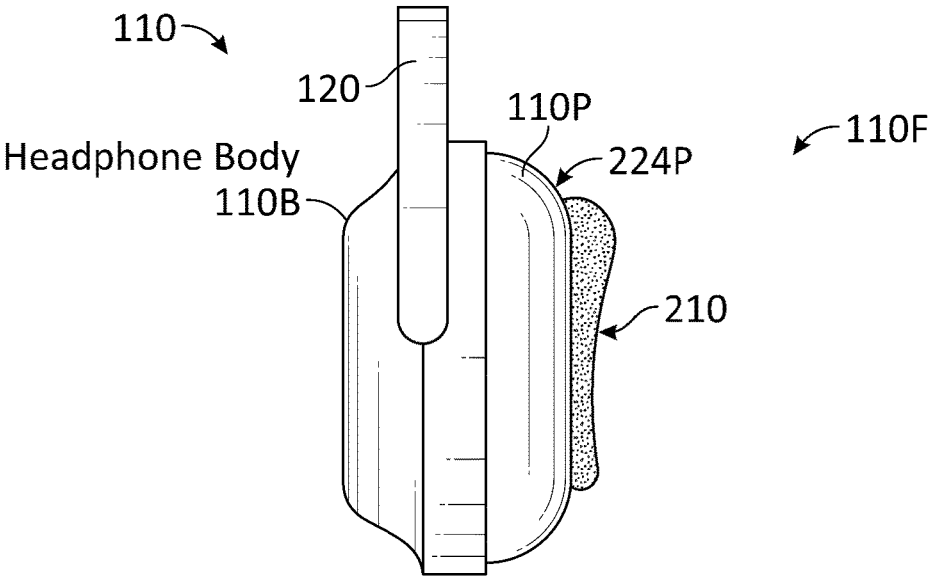
FIG. 2C is a side view of a headphone with an alignment structure, in accordance with one or more embodiments.
Figure 2D:
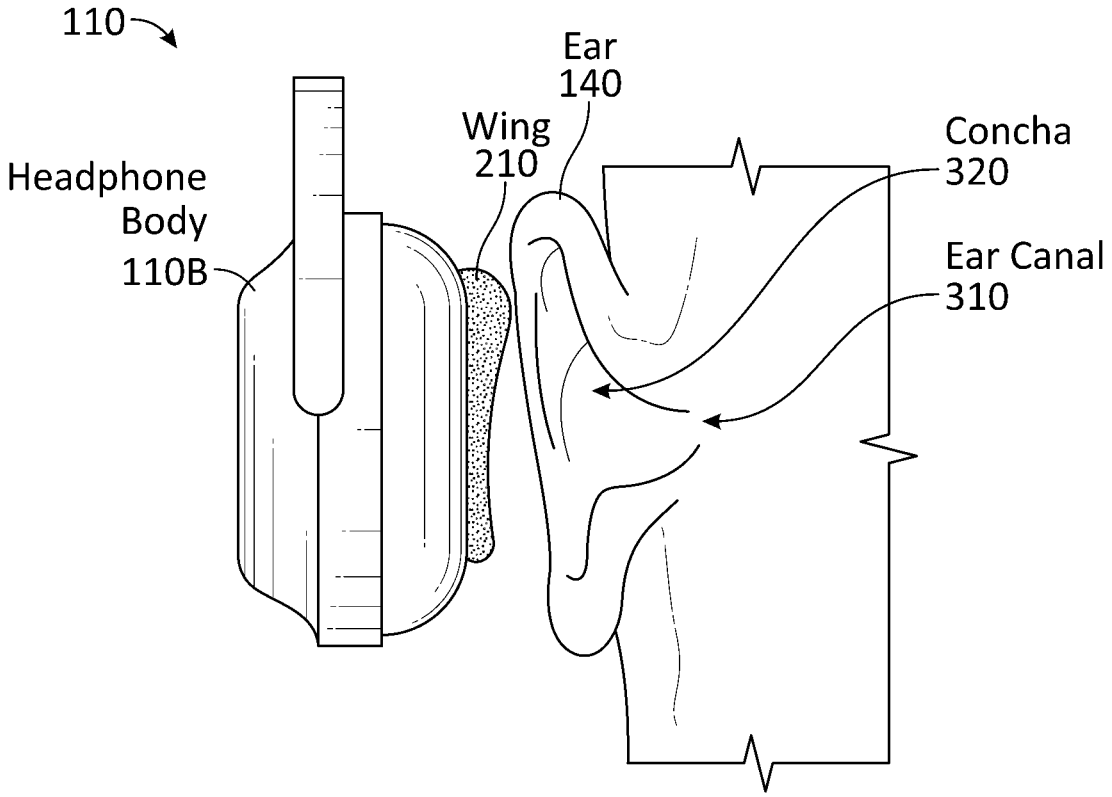
FIG. 2D is a side view of a headphone with an alignment structure aligned for insertion into an ear, in accordance with one or more embodiments.

FIGS. 2A-2D illustrate a headphone 110, including a headphone body 110B, an earpad 224, a sound emitting portion 220, and an alignment structure 210. In some embodiments, the alignment structure 210 is removably attachable to the earpad 224 allowing the headphone 110 to be used with the alignment structure (e.g., as illustrated in FIGS. 2B-D) or without the alignment structure 210 (e.g., as illustrated in FIG. 2A). FIG. 2A shows the headphone surface 110F facing the user's ear with the alignment structure 210 removed. FIG. 2B is the same view but with the alignment structure 210 attached thereto. FIG. 2C shows a side view of the headphone 110 with the alignment structure attached thereto. FIG. 2D is a side view, showing the headphone aligned for insertion into an ear 140 (right ear).

In various embodiments, the headphone 110 may be any on-ear headphone structure, including one or more speakers 144 or other sound emitter in a housing. The headphone includes a sound emitting portion 220 which may be located at an interior portion of the headphone surface 110F (e.g., at or near a center of the headphone surface) and covers a sound emitter configured to emit sound towards the ear. In some embodiments, when the headphone is in use, the sound emitting portion 220 is positioned adjacent to the entrance of the user's ear canal 310 (FIG. 2D) for optimal listening experience. In various embodiments, the optimal positioning of the speaker 144 and/or sound emitting portion 220 in the headphone and/or relative to the ear canal 310 may depend on the headphone style and design, the user's anatomy, user preferences and other criteria. Optimal design and configuration may be determined in a laboratory setting, for example, by testing the headphone and response using a specialized manikin and/or feedback from human subjects.

In some embodiments, the alignment structure 210 is a wing-shaped design attached to a peripheral area (e.g., attached or adjacent to earpad 224) surrounding or adjacent to the sound emitting portion 220. The alignment structure 210 may be positioned to avoid blocking the sound path from the speaker (sound emitter) to the ear canal, but it is recognized that some aspects of the alignment structure 210 may overlap into the sound path without substantially degrading performance. In the illustrated embodiment, the alignment structure 210 is positioned on the earpad 224P adjacent to the center area (e.g., sound emitting portion 220) and adapted to fit into the user's concha when the headphone is in use. In another embodiment, the alignment structure 210 and the earpad 224P may be designed as an integrated structure.

The earpad 224P is adapted to rest on or press against the pinna when the headphone is worn by the user. In some embodiments, the earpad 224P comprises a soft material that conforms, at least in part, to the user's ear structure when the headphone is worn and biased towards the ear by the headband. In some embodiments, the earpad is constructed as a single piece of memory foam, padding or similar material, which is covered by a soft covering material such as leather, synthetic leather, or similar material. The earpad 224P may be removably attached to the headphone body 110B, allowing for replacement of earpad 224P that may be damaged or worn, or replacement with a different style according to user preference.

The earpad 224P contacts the user's ear and increases the user's comfort while allowing soundwaves produced by the speaker to pass through to the ear. In some embodiments, the earpad 410224P substantially covers the headphone surface 110F, providing a soft contact area that conforms to the user's ear when in use. In some embodiments, the padding is circular or donut-shaped with a hole in the middle exposing the sound emitting portion 220. In use, the earpad 224P conforms to the structure of the user's ear, reducing the environmental noise in the ear canal and the leakage of sound generated by the sound emitter.

The headphone 110 may optionally include ANC circuit 160 and/or other headphone components such as one or more microphones, control buttons, adjustment mechanisms, and other processing systems and physical components as desired for a particular use. Headset 104 may include one or two headphones, and one or both may be as in FIGS. 2A-2C. When the headphone is worn by the user, the alignment structure 210 helps to optimally position (e.g., guide or align) the headphone on the ear. In various embodiments, the optimal position includes positioning the sound emitter adjacent to the ear canal, while aligning the on-ear headphones for a secure fit with reduced leakage (e.g., reduced gaps between the padding and the user's ear). In some embodiments, the alignment structure 210 is adapted to be placed in the ear's concha 320 (FIG. 2D), possibly (but not necessarily) touching the concha's floor and/or sidewall (e.g., at the antihelix). If the headphone is off the optimal position the user may feel the mispositioning due to abnormal physical contact with the alignment structure and/or abnormal lack of such contact and/or abnormal pressure on the ear.

The alignment structure 210 can be provided on one or both of headset's headphones 110, and be made of any suitable material, such as a memory foam that conforms to the user's concha and/or other ear structure, providing additional contact points to limit leakage and improve performance. In other embodiments, the alignment structure may be comprised of other suitable materials including silicone or other similar soft, compliant and/or resilient material. The alignment structure 210 may be adapted for comfort as a surface with rounded edges that conform to larger spaces within the ear structure. In some embodiments, the alignment structure is formed as a wing adapted to fit securely into the ear structure to further secure the headphone in alignment in connection with other headphone components, such as the resilient headband.

In some embodiments, the alignment structure 210 is formed as a single piece that may be attached to the exterior of the padding, on the interior of the padding covering, and/or connected to the headphone body through an opening in the padding and/or an area of the headphone surface adjacent to the sound emitting portion. The alignment structure may be formed as part of the padding as a single structure (e.g., memory foam) comprising one or more materials that incorporate both the padding and the alignment structure.

In other embodiments, a removable alignment structure enables a user to select one of a plurality alignment structure sizes, shapes and/or materials for improved fit/comfort/audio performance/preference for each user. A removable alignment structure may be attached to the exterior surface of the padding using, for example, an adhesive (e.g., glue), hook and loop fasteners (e.g., Velcro®), magnets incorporated into the wing and the headphone body 110B, and possibly other types, e.g. such as described below in connection with FIGS. 3A-B.

In various embodiments, the alignment structure may be adapted and positioned on the headphone to align the sound emitter with the ear canal for improved audio performance. The alignment structure may further be adapted to align the padding with the ear to reduce sound leakage by reducing open spaces between the padding and the ear that sound can enter and/or escape from. The alignment structure may further be adapted to conform to a portion of the ear geometry providing further protections against leakage. In some embodiments, the headphone includes ANC circuitry that is adapted for optimal performance with a headset aligned using the alignment structure. The alignment structure can be adapted to align the headphone body with the ear to optimize ANC performance, such as reducing/eliminating specific leakage paths and/or alignment of a noise cancelation zone (e.g., a location where the generated ANC anti-noise signal cancels the environmental noise) in the ear canal.

In some embodiments, the alignment structure effectively restricts the likely headphone positions relative to the user's ears, which simplifies testing and limits the number of scenarios/positions to be configured. As a result, headphones with the alignment structure of the present disclosure can be manufactured and configured to provide a more reliable user experience.

Figure 3A:
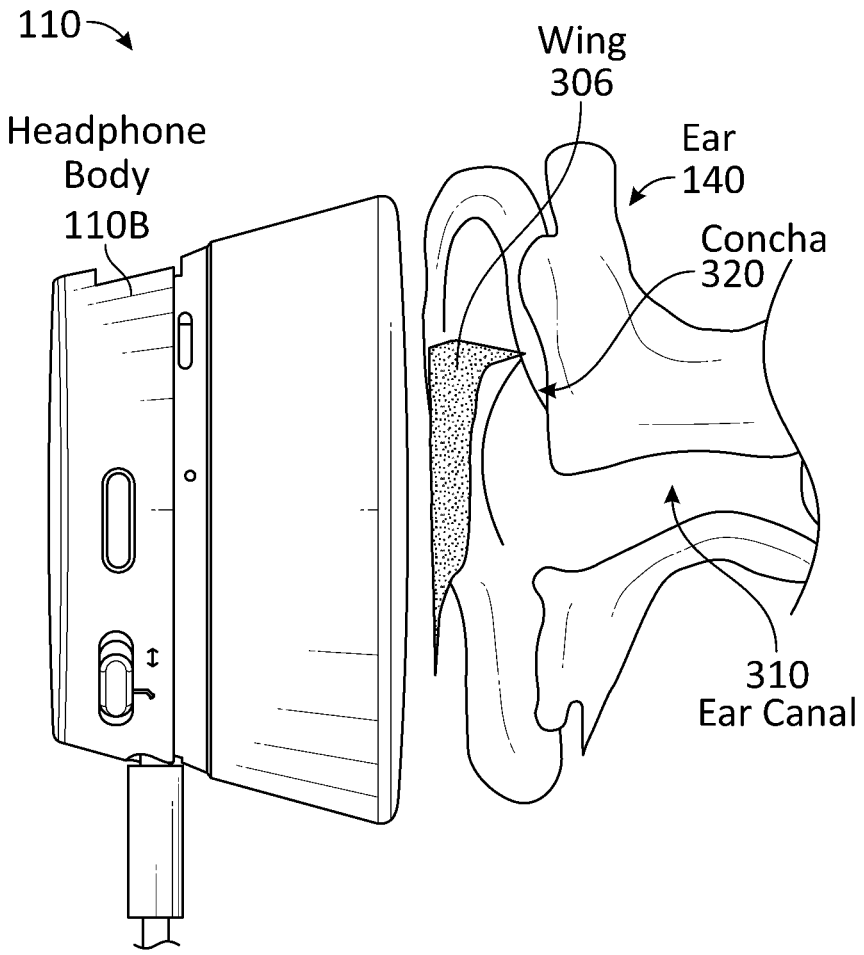
FIG. 3A is a side view of a headphone with a wing inserted into an ear, in accordance with one or more embodiments.
Figure 3B:
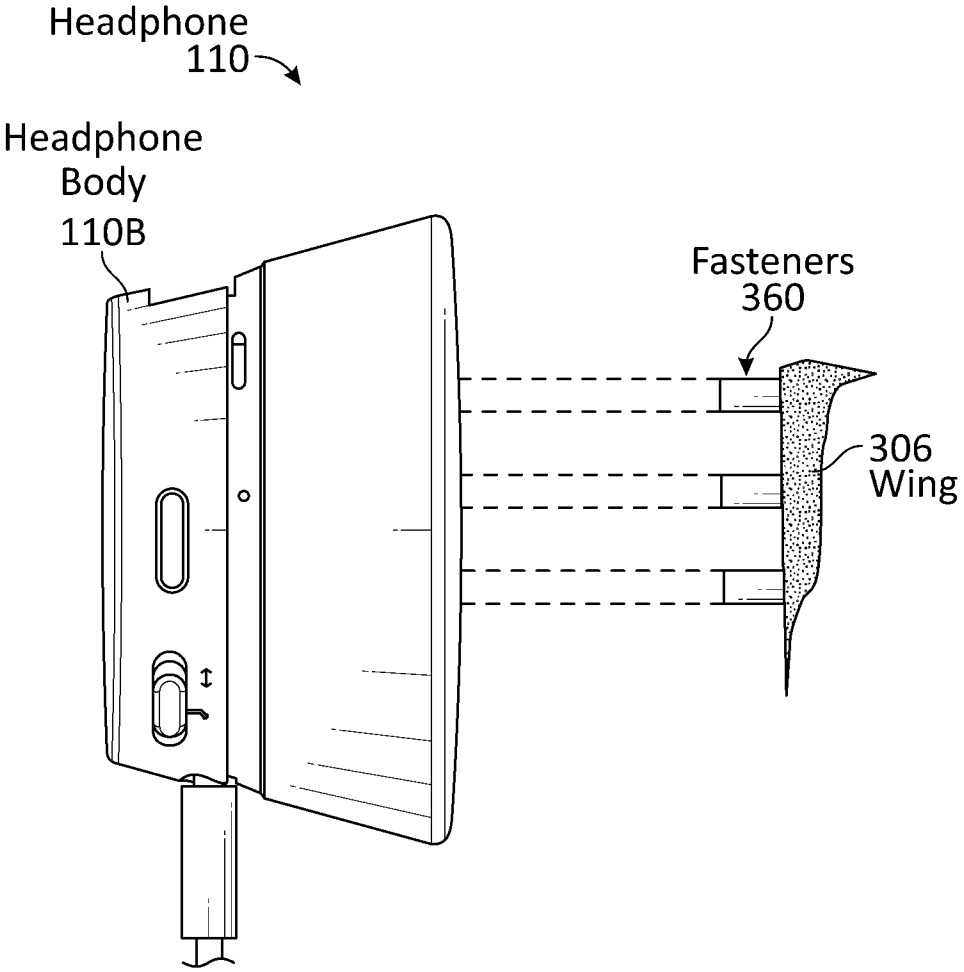
FIG. 3B is an exploded side view of a headphone with a wing, in accordance with one or more embodiments.

In some embodiments, a headphone may include an attachment point, such as a slot, for receiving and securing an alignment structure as disclosed herein. In various embodiments, the attachment point may be formed in an earpad for attachment to attachment components of an earpad, or for passing through to attachment components or features of a headphone housing. In the example of FIGS. 3A and 3B, a wing 306 is attached to headphone body 110B by fasteners 360, which can be pins snapped into matching slots in headphone body 110B, or pins that can be pressed into a slot or slots in headphone body 110B and slid into a locking position. A slot may be a hole passing through the body's housing, or an indentation in the body. Other attachment methods may include glue, hook and loop fasteners (like Velcro®), magnets, or other types. Any one or more fasteners, or any combination of fasteners, can be used.

Figure 4:
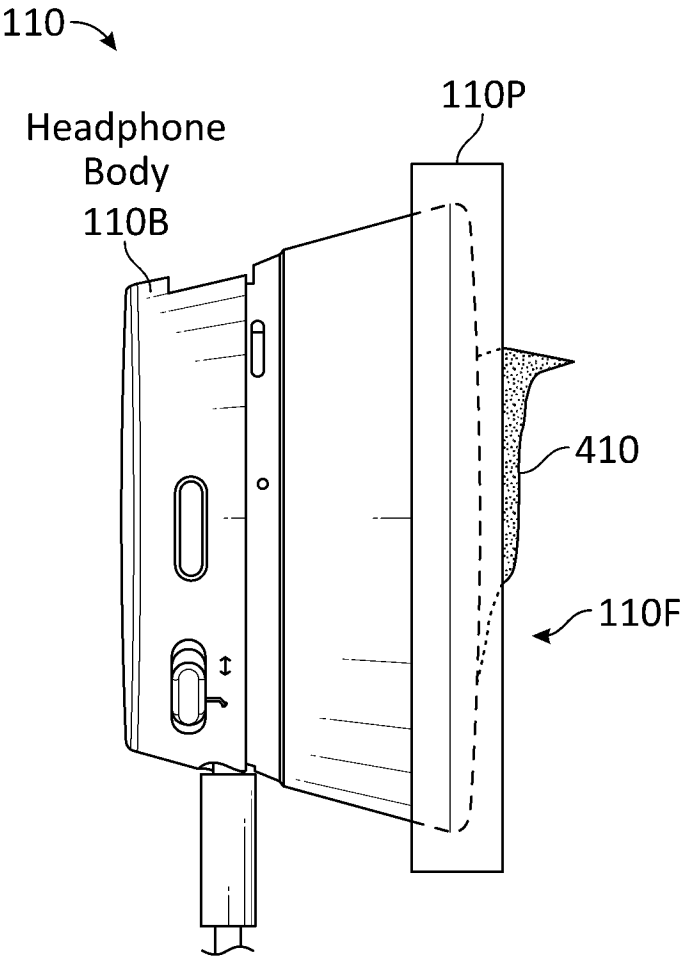
FIG. 4 is a side view of a headphone with a wing and an earpad, in accordance with one or more embodiments.

Headphone body 110B may include a possibly removable earpad 110P (FIG. 4) covering the circumference of the speaker housing of headphone body 110B. Earpad 110P is a soft, possibly removable earpad attached to the headphone body's front (ear-facing) side (headphone surface 110F) to provide soft padding and thus increase the user comport, improve the headphone/ear fit, and obstruct the sound leakage paths. Earpad 110P is made of a less rigid, more compliant material than the speaker housing surface covered by the earpad. In some embodiments, the wing 410 protrudes out farther towards the ear than the earpad 110*p*, allowing the wing 410 to engage the concha.

Figure 6:
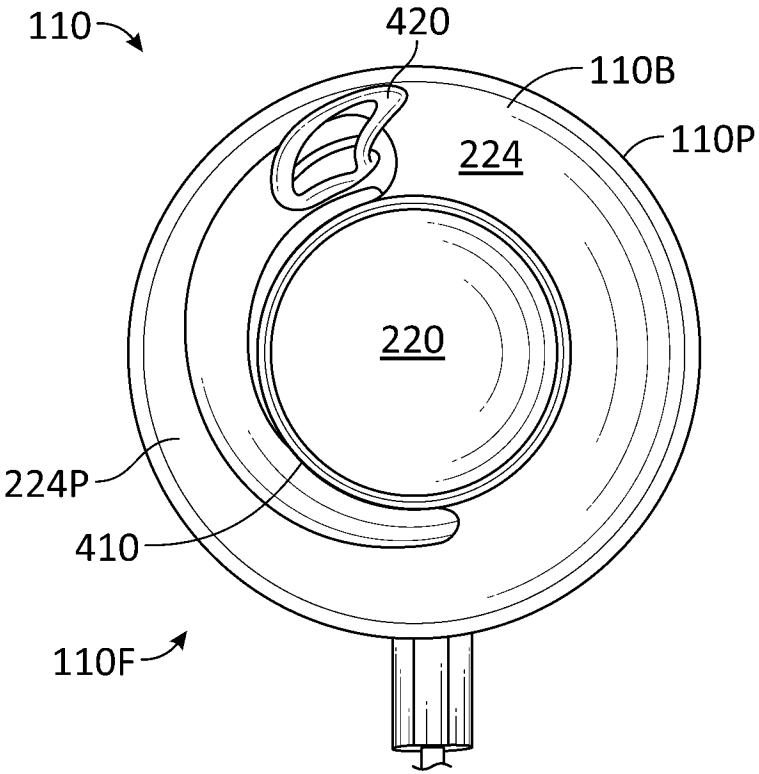
FIG. 6 is a front view of a headphone with a wing attached to an earpad, in accordance with one or more embodiments.
Figure 5:
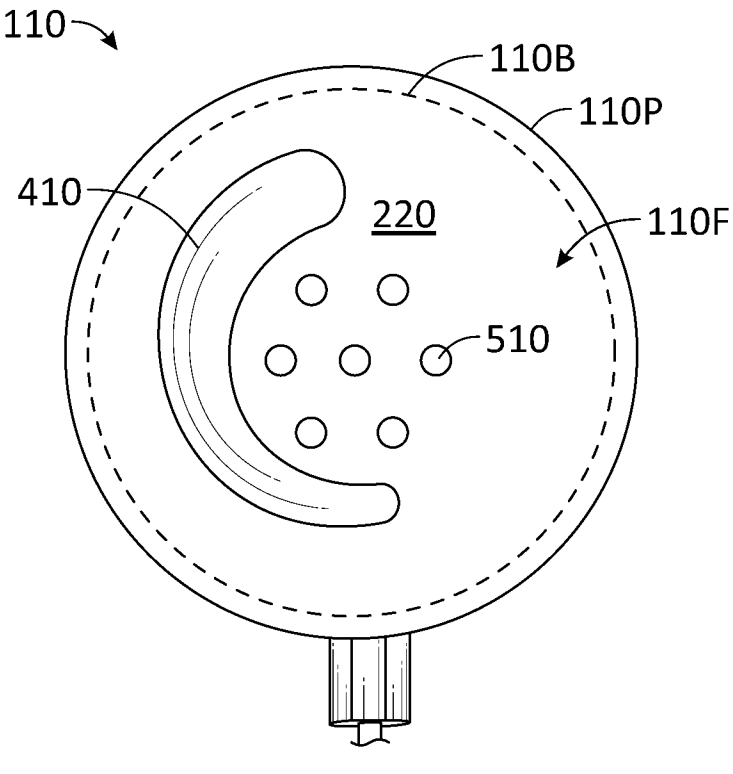
FIG. 5 is a front view of a headphone with a wing and an earpad, in accordance with one or more embodiments.

In FIG. 5, an earpad 110P covers the whole front side (e.g., headphone surface 110F) of the speaker housing. Earpad 110P may have holes 510 over the sound emitter (e.g., over sound emitting portion 220; see FIG. 5) in the sound path to the ear canal. Wing 410 may be attached externally to earpad, be incorporated into the earpad, and/or attached through a hole/slot in the earpad to adjoining attachment components or features in the earpad or housing. In some embodiments, the wing 410 is removably attached to the earpad and/or housing, using any of the attachment means described above and/or other means. In some embodiments, the wing 410 includes additional protruding wing member 420 adapted to fit securely in the concha of the ear to assist in a holding the headphone in alignment on the ear, for example, as illustrated in FIG. 6 showing the front view of such a headphone 110.

Various aspects may be described in the following numbered clauses:

Clause 1: A headphone comprising: a body having a first side to be pressed against a pinna of a user's ear when the headphone is in use, the body comprising a sound emitter configured to emit sound when the headphone is in use; and a wing at the first side of the body, the wing comprising a protrusion configured to extend into the ear's concha at least when the headphone is pressed from a second side opposite to the first side with a sufficient force, the wing being effective, when extended into the concha, to enable the user to feel headphone positioning relative to the user.

Clause 2: The headphone of clause 1, further comprising an earpad at the first side, wherein the earpad is configured to physically contact the ear's pinna and to separate the pinna from the body's surface facing the pinna and more rigid than the earpad's surface pressing against the pinna when the headphone is in use.

Clause 3: The headphone of clauses 1-2, wherein the wing protrudes out towards the ear farther than the earpad when the headphone is in use.

Clause 4: The headphone of clauses 1-3, wherein the wing's surface facing the ear is made of silicone.

Clause 5: The headphone of clauses 1-4, wherein the wing is made of memory foam.

Clause 6: The headphone of clauses 1-5, wherein the headphone is part of a headset.

Clause 7: The headphone of clauses 1-6, wherein when the headset is worn by the user, the wing exerts greater pressure on the pinna when the wing is not in the concha than when the wing is in the concha.

Clause 8: The headphone of clauses 1-7, wherein the wing is not in a direct path from the sound emitter to an entrance into the ear canal in a predefined normal position of the headphone relative to the ear.

Clause 9: The headphone of clauses 1-8, wherein the wing is adapted to enable the user to feel the headphone positioning to align the sound emitter with the ear canal.

Clause 10: The headphone of clauses 1-9, wherein the wing is adapted to enable the user to feel the headphone positioning to align the headphone with the ear to reduce sound leakage, and to minimize leakage variation.

Clause 11: The headphone of clauses 1-10, wherein the wing is adapted to enable the user to feel the headphone positioning to align the headphone with the ear to reduce open spaces between the headphone and the ear which are available for sound leakage.

Clause 12: The headphone of clauses 1-11, wherein the wing is adapted to enable the user to feel the headphone positioning to align the headphone with the ear to reduce Active Noise Cancelation (ANC) adaption for optimal ANC performance.

Clause 13: The headphone of clauses 1-12, wherein the headphone is part of an on-ear headset.

Clause 14: The headphone of clauses 1-13, wherein the wing is removably attached to the body.

Clause 15: The headphone of clauses 1-14, wherein the body comprises one or more fittings for attachment of any one of different wings.

Clause 16: The headphone of clauses 1-15, wherein the wing is attached to the body by being snapped into a slot in the body.

Clause 17: The headphone of clauses 1-16, wherein the wing is attached to the body by the wing's protrusion inserted into a slot in the body and slid in the slot to a locking position.

Clause 18: The headphone of clauses 1-17, wherein the wing is attached to the body using one or more hook and loop fasteners.

Clause 19: The headphone of clauses 1-18, wherein the wing is attached to the body using one or more magnets.

Clause 20: The headphone of clauses 1-19, wherein the wing is integral with the headphone earpad.

Clause 21: A method comprising: providing a headphone body having a first side adapted to be pressed against a pinna of a user's ear when the headphone is in use, the body comprising a sound emitter configured to emit sound when the headphone is in use; and forming a wing at the first side of the body, the wing comprising a protrusion configured to extend into the ear's concha at least when the headphone is pressed from a second side opposite to the first side with a sufficient force, the wing being effective, when extended into the concha, to enable the user to feel headphone positioning relative to the user.

Clause 22: The method of clause 21, further comprising attaching an earpad at the first side, wherein the earpad is configured to physically contact the ear's pinna and to separate the pinna from the body's surface facing the pinna and more rigid than the earpad's surface pressing against the pinna when the headphone is in use.

Clause 23: The method of clauses 21-22, wherein the wing protrudes out towards the ear farther than the earpad when the headphone is in use.

Clause 24: The method of clauses 21-23, further comprising molding the wing using silicone and/or memory foam.

Clause 25: The method of clauses 21-24, further comprising adapting a shape of the wing to exert greater pressure on the pinna when the wing is not in the concha than when the wing is in the concha.

Clause 26: The method of clauses 21-25, further comprising positioning the headphone adjacent to the ear using the wing to enable the user to feel the headphone positioning to align the sound emitter with the ear canal.

Clause 27: The method of clauses 21-26, further comprising adapting the wing to enable the user to feel the headphone positioning to align the headphone with the ear to reduce open spaces between the headphone and the ear which are available for sound leakage.

Clause 28: The method of clauses 21-27, further comprising adapting the wing to enable the user to feel the headphone positioning to align the headphone with the ear to reduce Active Noise Cancelation (ANC) adaption for optimal ANC performance.

The foregoing is not intended to limit the present disclosure to the precise forms or particular fields of use disclosed. Other variations are possible. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. An apparatus comprising:

an on-ear headphone body comprising:

a first surface having a sound emitting portion;

one or more speakers disposed in the headphone body and arranged to emit sound through the sound emitting portion of the first surface;

an earpad attached to the first surface that substantially conforms to a pinna of an ear to reduce sound leakage paths; and an alignment structure protruding from the earpad and adapted to guide an alignment of the headphone body with the ear.

2. The apparatus of claim 1, wherein the apparatus further comprises a resilient headband attached to the headphone body and adapted to bias the first surface of the headphone body towards the ear.

3. The apparatus of claim 1, wherein the earpad is donut-shaped pad forming a hole that exposes the sound emitting portion.

4. The apparatus of claim 1, wherein the alignment structure and earpad are formed as a single structure comprising memory foam.

5. The apparatus of claim 1, wherein the alignment structure is attached to an exterior of the earpad, on an interior of the earpad, connected to the headphone body through an opening in the earpad or in the headphone body adjacent to the sound emitting portion.

6. The apparatus of claim 1, wherein the alignment structure guides the headphone body to form a sound path between the sound emitting portion and an ear canal opening of the ear.

7. The apparatus of claim 1, wherein the alignment structure fits into an opening formed in a concha of the ear when the headphone body is aligned with the ear.

8. The apparatus of claim 1, wherein the alignment structure contacts a concha of the ear to tactilely indicate to a misalignment of the headphone to the ear.

9. The apparatus of claim 1, wherein the alignment structure is formed as a wing that fits securely into a structure of the ear to secure the headphone in alignment.

10. The apparatus of claim 1, wherein the alignment structure is a detachable alignment structure configured to enable a user to select one of a plurality alignment structures in accordance with a physical structure of the ear.

11. The apparatus of claim 10, further comprising an attachment point configured to secure the detachable alignment structure; wherein the attachment point is disposed in or on the headphone body.

12. The apparatus of claim 1, wherein the alignment structure is a detachable alignment structure attached to an exterior surface of an earpad using an adhesive, hook and loop fasteners, and/or magnets.

13. The apparatus of claim 1, wherein the alignment structure comprises silicone.

14. The apparatus of claim 1, wherein the apparatus further includes active noise cancellation circuitry;

wherein the alignment structure restricts wearable headphone body positions relative to the ear; and wherein the active noise cancellation circuitry is optimized for the restricted wearable headphone body positions.

15. A method comprising:

providing an on-ear headphone body comprising a first surface having a sound emitting portion and one or more speakers disposed in the on-ear headphone body and arranged to emit sound through the sound emitting portion of the first surface;

attaching, to the first surface, an earpad comprising a foam structure that substantially conforms to a pinna of an ear to reduce sound leakage paths;

attaching an alignment structure to the on-ear headphone body so that the alignment structure protrudes from the earpad; and guiding an alignment of the on-ear headphone body with the ear based, at least in part, on a sensed contact between the alignment structure and the ear.

16. The method of claim 15, wherein guiding an alignment further comprises positioning the alignment structure into an opening of a concha of the ear to align the on-ear headphone body with the ear.

17. The method of claim 15, wherein guiding an alignment further comprises detecting contact between the alignment structure and a concha of the ear indicating a misalignment of the headphone to the ear.

18. The method of claim 15, further comprising:

providing active noise cancellation circuitry in the on-ear headphone body;

identifying aligned on-ear headphone body positions relative to the ear based on the alignment structure; and tuning the active noise cancellation circuitry for the identified aligned on-ear headphone body positions.

* * * * *